United States Patent [19]

Anhalt

[11] 4,196,955

[45] Apr. 8, 1980

[54] ZERO INSERTION FORCE CONNECTOR

[75] Inventor: John W. Anhalt, Orange, Calif.

[73] Assignee: International Telephone and Telegraph Corporation, New York, N.Y.

[21] Appl. No.: 10,060

[22] Filed: Feb. 7, 1979

[51] Int. Cl.[2] ..... H01R 13/62

[52] U.S. Cl. ..... 339/74 R; 339/75 MP

[58] Field of Search ..... 339/74 R, 75 M, 75 MP, 339/176 MP

[56] References Cited

U.S. PATENT DOCUMENTS

| | | | |
|---|---|---|---|
| 3,963,317 | 6/1976 | Eigenbrode et al. | 339/74 R |
| 4,152,037 | 5/1979 | Bonhomme | 339/75 MP |
| 4,159,154 | 6/1979 | Arnold | 339/75 MP X |
| 4,159,861 | 7/1979 | Anhalt | 339/75 MP |

*Primary Examiner*—Roy Lake
*Assistant Examiner*—Eugene F. Desmond
*Attorney, Agent, or Firm*—Thomas L. Peterson

[57] ABSTRACT

An electrical connector in which two rows of resilient contacts are mounted in a connector housing on opposite sides of a slot which is adapted to receive a printed circuit board or similar electrical component therein. The end portion of the spring contacting section of each contact is reversely bent in a direction away from the slot. A vertically movable contact shifting element is disposed between the spring contacting sections and the reversely bent end portions of the contacts in each row of contacts. A cam actuator is operated to move the contact shifting elements upwardly against the reversely bent end portions of the contacts thereby deflecting the spring contacting sections away from the slot so that a printed circuit board may be inserted therein with zero insertion force. Teeth are provided on the contact shifting element and cam actuator which interlock and thereby restrict upward movement of the contact shifting element except during operation of the cam actuator. Cooperating cams are provided on the cam actuator and housing causing the actuator to rise to facilitate interlocking of the teeth.

3 Claims, 9 Drawing Figures

FIG. 3
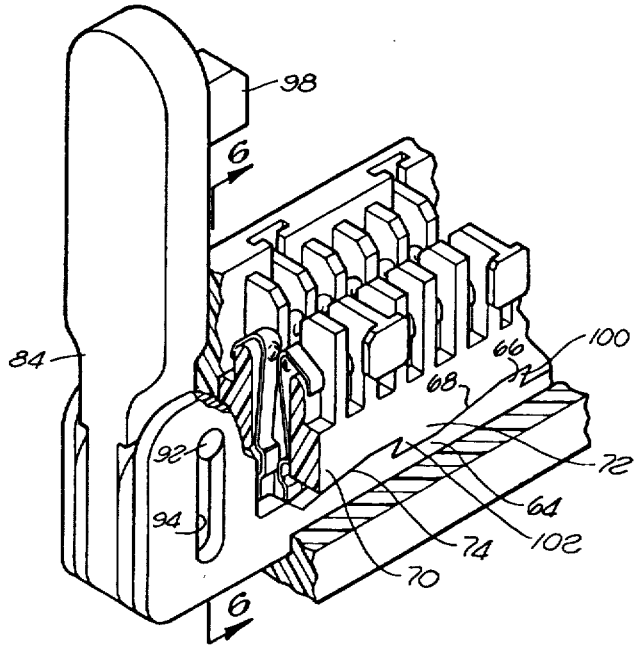
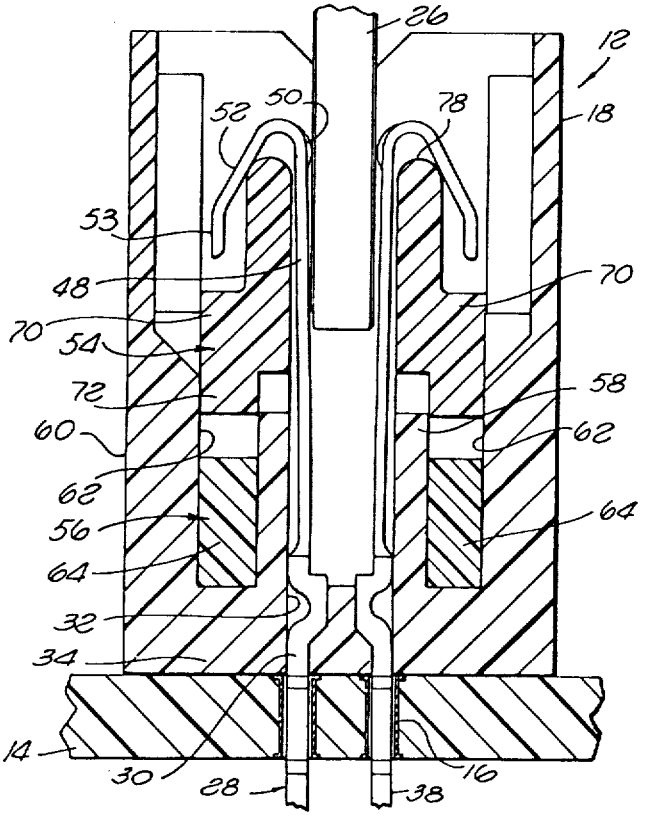
FIG. 4

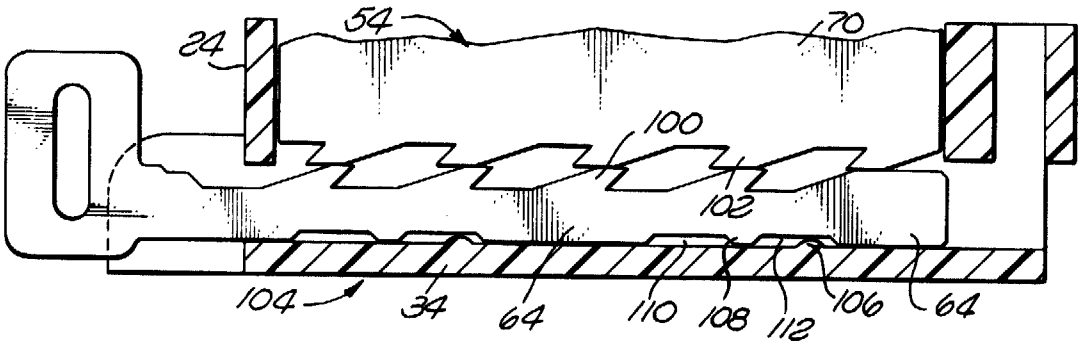
FIG. 7 OPEN
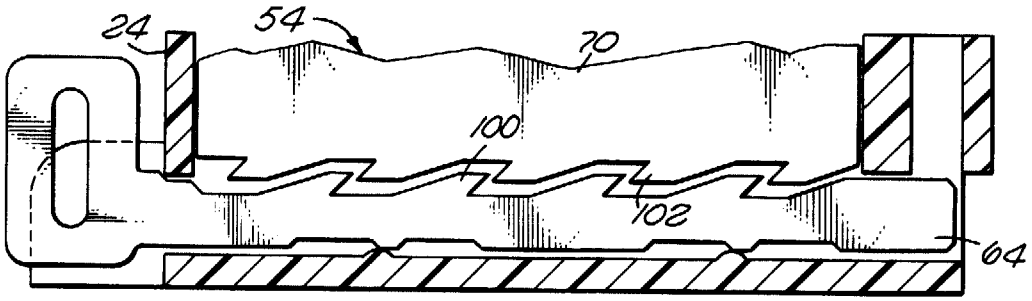
FIG. 8 ENGAGEMENT
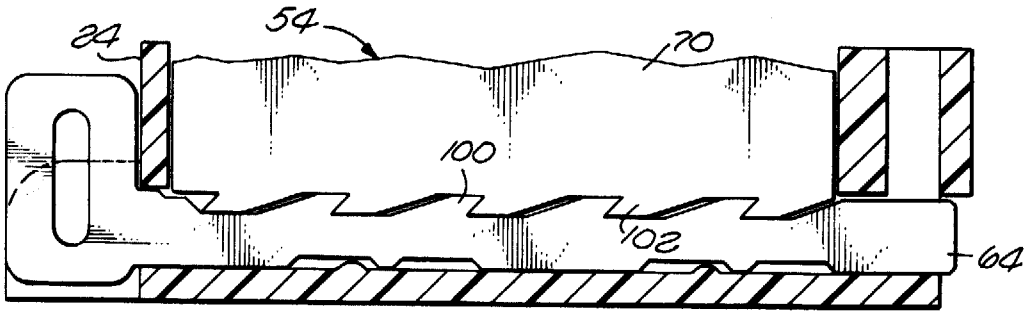
FIG. 9 CLOSED

ZERO INSERTION FORCE CONNECTOR

BACKGROUND OF THE INVENTION

This invention relates generally to an electrical connector and, more particularly, to a zero insertion force electrical connector having cam means therein for actuating the contacts out of engagement with conductors on an electrical component.

It is well known in the art that substantial force is required to insert a printed circuit board into a connector having a large number of spring contacts therein due to the resilient engaging force of the contacts with the edge of the board. As the number of contacts is increased in a connector, the amount of force required to insert the printed circuit board into the connector, or to withdraw it from the connector, may become excessive for practical use. In addition, direct insertion of boards into connectors having spring contacts therein results in a wiping action occurring between the contacts and the conductive traces on the edge of the board, which may cause excessive wear of the traces over lengthy periods of use of the connector. It is, therefore, a common practice in the art to provide a zero insertion force printed circuit board connector in which the contacts are mounted out of the path of movement of the board when it is inserted into the connector whereby no resistance is encountered upon inserting the board thereinto.

There are two general types of zero insertion force connectors, one in which the contacts are normally closed and the other in which the contacts are normally open. In the case of a connector having normally open contacts, the contacts are normally unloaded (that is, no stresses are applied to the contacts) and the contacts are cammed against the printed circuit board. In a connector having normally closed contacts, the contacts are preloaded in the connector housing in a position to resiliently engage a printed circuit board mounted therein and a cam actuator is provided for retracting the contacts away from the standard engagement position so that a board may be inserted into the housing with zero insertion force. The present invention relates to a zero insertion force connector having normally closed contacts.

In copending application of J. W. Anhalt, Ser. No. 866,031, filed Dec. 30, 1977, now U.S. Pat. No. 4,159,861, issued July 3, 1979, assigned to the assignee of the present application, there is disclosed a normally closed zero insertion force, printed circuit board connector comprising an elongated insulative housing having a row of contacts therein. The housing has a slot opening to the top for receiving the printed circuit board. Each contact has a mounting portion and a spring contacting portion which extends upwardly from the mounting portion at an angle in one direction toward a vertical plane passing through the opening in the housing. An arm on the spring contacting portion of each contact extends downwardly at an angle in a direction away from said vertical plane. Means is provided for retracting the contacting portions of the contacts away from the vertical plane. The retracting means includes a contact shifting element and a cam actuator. The contacting shifting element is disposed between the spring contacting portions and the downwardly extending arms on the contacts. The contacting shifting element is movable vertically between a lower position and an upper position, and embodies a cam surface which engages the arms on the contacts for retracting the contacting portions of the contacts away from the vertical plane when the contacting shifting element is moved from its lower position to its upper position. The cam actuator is operated in one direction to move the contact shifting element from the lower position to the upper position to open the contacts so that a printed circuit board may be inserted into the housing with zero insertion force.

After the board is inserted into the slot, the cam actuator is operated in the opposite direction whereupon the contact shifting element returns to its lower position under the spring bias of the downwardly extending arms of the contacts. However, when the connector is subjected to vibration or shock, the contact shifting element may move vertically. The resulting inertial forces of the moving element are sometimes transferred to the contacts, thus causing contact vibration and possible intermittance in electrical engagement with the printed circuit board.

Copending application of B. K. Arnold, Ser. No. 894,934, filed Apr. 10, 1978, now U.S. Pat. No. 4,159,154, issued June 26, 1979, assigned to the assignee of the present application, discloses a solution to the foregoing problem of contact vibration, namely, the provision of latching means for restricting movement of the contact shifting element to its upper position except during operation of the cam actuator to open the contacts. Such latching means comprises interlocking teeth on the contact shifting element and the cam actuator. However, it has been found that due to excessive friction between the contact shifting element and the connector housing, engagement and positive locking of the teeth is not consistently attained. The object of the present invention is to overcome this problem.

SUMMARY OF THE INVENTION

According to a principal aspect of the present invention, there is provided a zero insertion force electrical connector comprising an elongated insulative housing having a row of contacts therein. The housing has an opening to the top for receiving therein conductors on an electrical component, such as a printed circuit board having conductive traces on the edge of the board. Each contact has a spring contacting portion extending toward a vertical plane passing through the opening. Means is provided for retracting the contacting portions of the contacts away from the vertical plane. The retracting means comprises contact shifting means and cam actuator means. The contact shifting means is movable between a lower position and an upper position. The contact shifting means embodies cam surface means engaging the contacts for retracting the contacting portions of the contacts away from the vertical plane when moved from its lower position to its upper position.

The cam actuator means comprises an elongated element mounted for longitudinal shifting movement in the housing below the contact shifting means. The element is slidable in one direction to move the contact shifting means from its lower position to its upper position. Adjacent surfaces of the contact shifting means and the cam actuator element embody cooperating inclined cam ramps terminating in teeth which interlock when the contact shifting means is in its lower position. The teeth disengage when the cam actuator element is slidable in said one direction. Means is provided for causing the cam actuator element to rise to facilitate interlocking of the teeth during movement of the cam actuator element in said opposite direction.

Thus, according to the invention, while the cam actuator element is shifted longitudinally to allow the contact shifting means to move to its lower position to close the contacts in the connector, the cam actuator is lifted to cause the teeth thereon to overlap the teeth on the contact shifting means, thus assuring that the contact shifting means will be positively moved to its lower position to allow the contacts to close when the cam actuator element is returned to its normal position.

BRIEF DESCRIPTION OF THE DRAWINGS

FIG. 3 is a perspective view of one end of the connector illustrated in FIG. 2 showing the actuating handle in its upper position in which the contacts are closed, with a portion of the connector housing broken away to show the interlocking teeth on the cam actuator and contacting shifting elements;

FIG. 4 is a vertical sectional view similar to FIG. 2 but showing the contacts in their actuated, open position;

FIGS. 7, 8, and 9 are fragmentary, partial longitudinal sectional views of the connector showing three different positions of the cam actuator and the cams of the present invention which facilitate interlocking of the teeth on the cam actuator and contact shifting elements.

DESCRIPTION OF THE PREFERRED EMBODIMENTS

Figure 1:
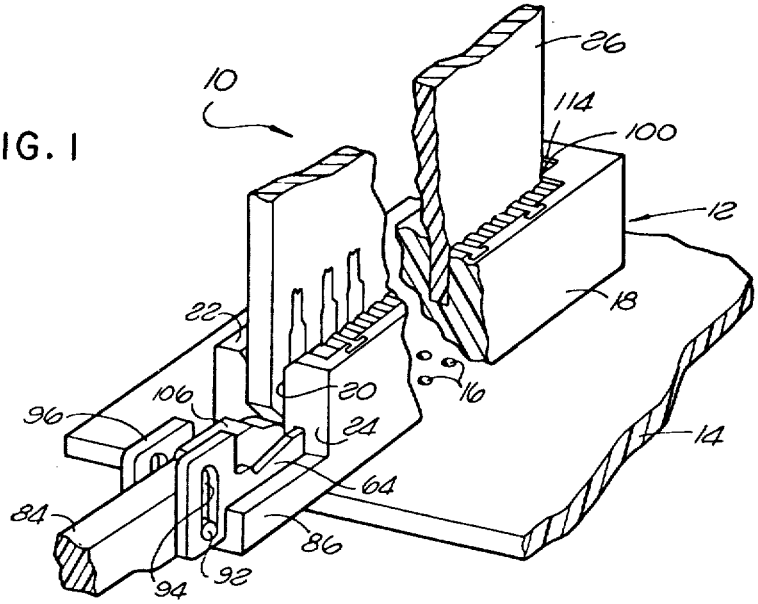
FIG. 1 is a perspective view of an electrical connector assembly embodying the connector of the present invention with a printed circuit board inserted therein and the actuating handle of the connector shown in its lower position.

Referring now to FIG. 1 of the drawings in detail, there is illustrated an electrical connector assembly, generally designated 10, like that disclosed in the aforementioned copending Arnold application.

Basically, the connector assembly 10 comprises a zero insertion force printed circuit board connector, generally designated 12, which is mounted on an insulative planar substrate 14, which may be a printed circuit board having two rows of plated through holes 16 therein. The connector 12 comprises an elongated insulative housing 18 having a slot 20 therein which opens to the front or top 22 of the housing as well as at the one end 24 thereof. A printed circuit board 26 is shown mounted in the slot.

Figure 2:
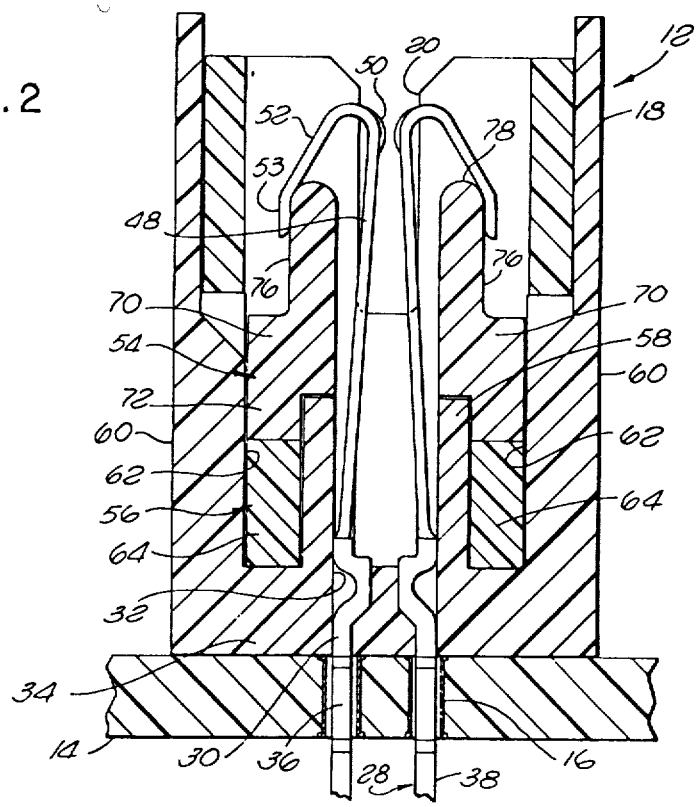
FIG. 2 is a vertical sectional view of the electrical connector assembly illustrated in FIG. 1 in which the contacts are shown in their normal unactuated, closed position.

As seen in FIG. 2, two rows of contacts 28 are mounted in the connector housing 18 on opposite sides of a vertical plane which passes through the center of the printed circuit board receiving slot 20. Each contact has an upper mounting portion 30 which is frictionally mounted in an aperture 32 in the bottom wall 34 of the connector housing and a lower mounting portion 36 which is press-fit into a plated-through hole 16 in the substrate 14. A wire-wrap tail or post 38 extends downwardly from the lower mounting portion of the contact.

Each contact embodies a spring contacting portion 48 which extends upwardly at an angle toward a vertical plane which passes through the slot 20 in the connector housing. A rounded protuberance 50 is provided on the inner surface of the upper end of the contacting portion 48 which is adapted to engage a trace on a printed circuit board inserted into the slot 20. The upper end portion of the spring contacting portion of the contact is reversely bent to provide an arm 52 which extends downwardly at an angle away from the vertical plane passing through the slot 20. Each arm terminates in a vertically extending end section 53. As seen in FIG. 2, the contacting portions of the contacts in the two rows of contacts in the connector housing are located in their normally closed, unactuated position. Means is provided for retracting the contacting portions of the contacts away from a vertical plane passing through the slot 20. Such means comprises contact shifting means, generally designated 54, and cam actuator means, generally designated 56.

A pair of upstanding short inner walls 58 are formed on the lower wall 34 of the connector housing on opposite sides of the two rows of contacts. The walls 58 are spaced from the outer walls 60 of the housing to provide a pair of elongated narrow slots 62. The cam actuator means 56 comprises a pair of elongated elements 64 which are longitudinally slidable in the slots 62 in the housing. Upwardly extending projections 66 are spaced longitudinally on the upper surface of each cam actuator element 64. Each projection 66 provides an upwardly facing inclined ramp 68 as seen in FIG. 3.

The contact shifting means 54 comprises a pair of elongated vertically movable members 70 having downwardly extending projections 72 thereon complementary to the projections 66 and providing downwardly facing inclined ramps 74 which engage the ramps 68. Each member 70 embodies a narrow upwardly extending portion 76 which extends lengthwise below the arms 52 of the contacts and inside the vertical end sections 53 of the arms. An arcuate cam surface 78 is formed on the upper end of the narrow portion 76 of each cam shifting member 70. As seen in FIG. 2, when the contacts are in their normally closed, unactuated position, the arcuate cam surfaces 78 on the cam shifting members 70 are positioned immediately below the angular portions of the arms 52 of the contacts.

In order to actuate the contacts, the cam actuator elements are shifted longitudinally toward the end 24 of the connector housing whereby the inclined ramps 68 and 74 on the elements 64 and 70, respectively, cooperate to move the contact shifting members 70 upwardly. As the members 70 move upwardly, the arcuate cam surfaces 68 on the upper ends of the members 70 cooperate with the angular arms 52 on the contacts causing the contacting portions of the contacts to be shifted away from a vertical plane passing through the slot 20 in the connector housing as seen in FIG. 4, whereby the contacts are then located in an open position which will allow the printed circuit board 26 to be mounted through the slot 20 into the connector housing between the two rows of contacts with zero insertion force.

Figure 6:
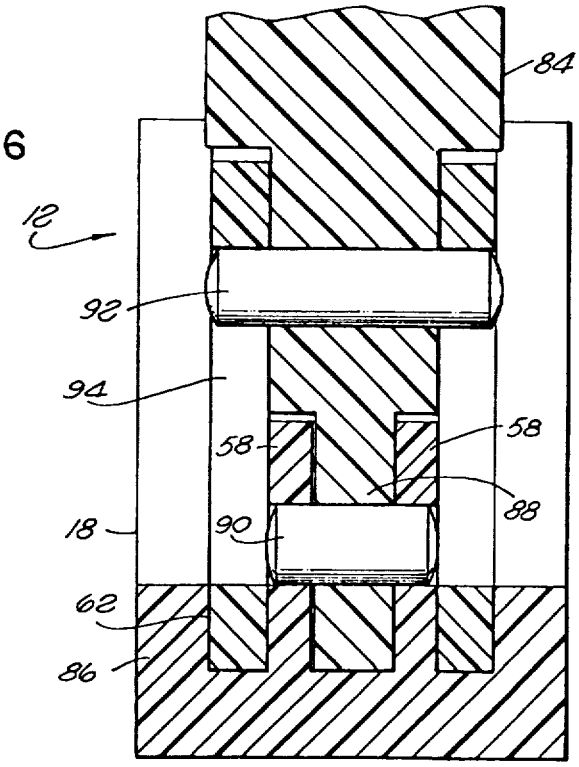
FIG. 6 is a vertical sectional view taken along line 6—6 of FIG. 3.

The cam actuator elements 64 are shifted longitudinally in the connector housing by means of an actuating handle 84 mounted on the end of the connector housing. The housing embodies an extension 86 extending outwardly from the end 24 thereof. As seen in FIG. 6, the slots 62 and inner walls 58 extend outwardly to the end of the extension 86. The handle has a narrow inner portion 88 which extends between the walls 58, and is pivotally mounted relative to the connector housing by means of a pin 90 extending through aligned holes in the walls 58 and inner portion 88 of the handle. A second pin 92 extends transversely through the handle above the pin 90. The ends of the pin 92 are slidable in vertical slots 94 in end portions 96 of the cam actuator elements 64.

Figure 5:
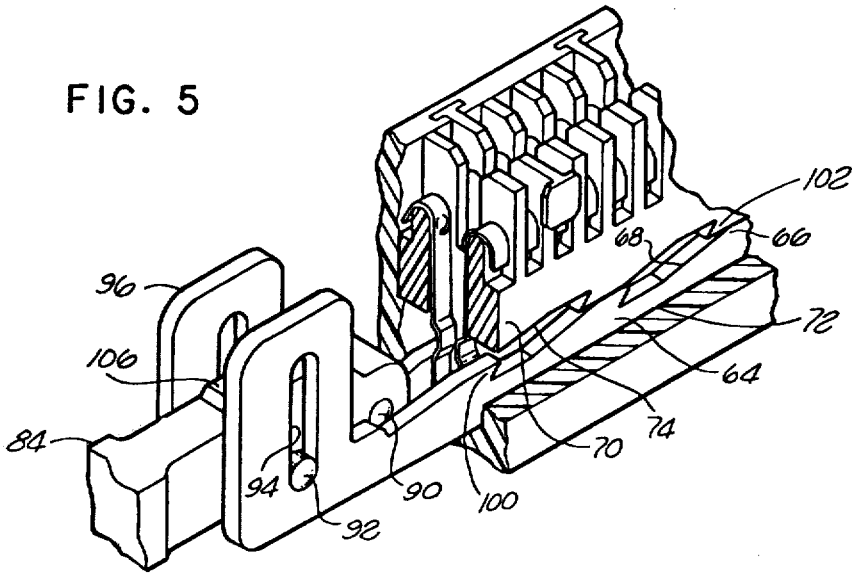
FIG. 5 is a perspective view similar to FIG. 3 but showing the actuating handle of the connector in its lower position wherein the contacts are open, as illustrated in FIG. 4.

When the actuating handle 84 is in its upper position as illustrated in FIGS. 3 and 6, the cam actuator elements 64 are located in the connector housing so that the cam shifting members 70 are in their lower position wherein the two rows of contacts 28 are in their normally closed, unactuated position. It will be appreciated that when the actuating handle is in such upper position, the handle blocks the end of the slot 20 in the connector housing to prevent insertion of the printed circuit board 26 into the housing while the contacts are in their closed position. A projection 98 is formed on the handle 84, as seen in FIG. 3, which extends inwardly over the connector housing in alignment with the slot 20 therein to form a second blocking element which will prevent insertion of the printed circuit board into the slot from the front or top of the housing. When it is desired to insert a printed circuit board into the housing, the actuating handle 84 is moved to its lower position as seen in FIGS. 1 and 5 which causes the cam actuator elements 64 to be shifted outwardly of the housing which in turn causes the contact shifting members 70 to move upwardly as seen in FIG. 4 to retract the contacting portions of the contacts away from the printed circuit board receiving slot 20 so that the board 26 may be inserted into the slot with zero insertion force. When the handle 84 is in its lower position, the board 26 may be inserted into the housing from either the front or end thereof. After the board 26 is inserted into the slot, the handle 84 is raised to its upper position which allows the contacts to spring inwardly toward their normally closed position whereby they engage the conductive traces on the sides of the printed circuit board. Also, the angular arms 52 on the contacts resiliently urge the contact shifting members 70 to their lower position shown in FIG. 2.

Latching means is provided to prevent upward movement of the contact shifting elements 70 after the contacts have engaged the printed circuit board, so that the contacts will not vibrate due to inertial forces on the elements 70 when the connector is subjected to vibration or shock. The latching means comprises reverse angle undercuts at the ends of the projections 66 and 72 providing teeth 100 and 102, respectively, on the cam actuator elements 64 and contact shifting members 70. The teeth interlock, as shown in FIG. 3, when the actuating handle 84 is in its upper position to assure that the members 70 are fully seated and locked in place against the cam elements 64. This interlock also allows the contacts unrestricted travel and, hence, full spring engagement with the traces on the board 26. It will be appreciated that the interlocking teeth disengage when the handle 84 is lowered so that the contact shifting members 70 are free to move upwardly to open the contacts.

In accordance with the present invention, means is provided for causing the cam actuator elements 64 to rise to facilitate interlocking of the teeth on the elements and the contact shifting members 70 when the cam actuator elements are moved inwardly into the connector housing to allow the contacts to close. Such means, as illustrated in FIGS. 7 to 9, comprise two sets of cam surfaces, each designated 104, formed on the mating surfaces of the cam actuator elements 64 and the bottom wall 34 of the connector housing. Each such cam surface arrangement comprises an upstanding, rounded projection 106 on the bottom wall 34 and a downwardly extending projection 108 defined by two longitudinally spaced notches 110 and 112 formed in the bottom of the cam actuator element 64. In FIG. 7, the cam actuator elements (only one being visible) are in their outer position, corresponding to that illustrated in FIG. 5, wherein the cam ramps 68 and 66 cooperate to hold the contact shifting members 70 in their upper position wherein the contacts are open. In such position of the cam actuator elements 64, the projections 106 extend into the notches 112 closest to the inner ends of the elements. When the cam actuator elements 64 are shifted inwardly into the connector housing, the downwardly extending projections 108 thereon cooperate with the upstanding projections 106 on the bottom wall of the housing causing the cam actuator elements to rise, as seen in FIG. 8, so that the teeth 100 will just slightly overlap the teeth 102 on the contact shifting members 70. Thus, as the cam actuator elements 64 continue to move inwardly into the connector housing to the position illustrated in FIG. 9, the projections 108 will pass beyond the projections 106 allowing the elements to drop to their lower position, thus effecting positive downward movement of the contact shifting members 70 to their lowermost position, thereby assuring that the members 70 cannot rise to cause contact vibration or intermittance in electrical engagement of the contacts with the printed circuit board in the connector.

Thus, by the present invention, the camming arrangement 104 imparts a vertical rising movement to the cam actuator elements together with their existing longitudinal travel so that it is assured that the teeth 100 and 102 will overlap and interlock when the cam actuator elements are shifted to a position to allow the contact to close. Obviously, camming arrangements other than those specifically disclosed herein may be utilized within the scope of the present invention to effect vertical travel of the cam actuator elements during their longitudinal movement to assure interlocking of the teeth on the elements and the contact shifting members.

What is claimed is:

1. A zero insertion force electrical connector comprising:

an elongated insulative housing having a row of contacts therein, said housing having a bottom wall and an opening to the top for receiving therein conductors on an electrical component;

each said contact having a spring contacting portion extending toward a vertical plane passing through said opening;

means for retracting said contacting portions of said contacts away from said vertical plane, said retracting means comprising contact shifting means and cam actuator means;

said contact shifting means being movable between a lower position and an upper position, said contact shifting means embodying cam surface means engaging said contacts for retracting said contacting portions of said contacts away from said vertical plane when moved from said lower position to said upper position;

said cam actuator means comprising an elongated element mounted for longitudinal sliding movement in said housing below said contact shifting means, said element being slidable in one direction to move said contact shifting means from said lower position to said upper position and being slidable in the opposite direction to allow said contact shifting means to return to said lower position from said upper position;

the adjacent surfaces of said contact shifting means and said element embodying cooperating inclined cam ramps terminating in teeth which interlock when said contact shifting means is in said lower position, said teeth disengaging when said element is slidable in said one direction; and means causing said element to rise to facilitate interlocking of said teeth during movement of said element in said opposite direction.

2. A zero insertion force electrical connector as set forth in claim 1 wherein:

said last-mentioned means comprises cooperating cam surfaces on the bottom of said element and on the bottom wall of said housing.

3. A zero insertion force electrical connector as set forth in claim 2 wherein:

said cam surfaces comprise two longitudinally spaced notches formed in the bottom of said element defining a downwardly extending projection therebetween and an upstanding projection on said bottom wall of said housing extending into one of said notches when said contacting shifting means is in said lower position and extending into the other of said notches when said contact shifting means is in said upper position.

* * * * *